US009072942B2

(12) United States Patent
Huang et al.

(10) Patent No.: US 9,072,942 B2
(45) Date of Patent: Jul. 7, 2015

(54) INTEGRATED FLYWHEEL SET FOR EXERCISE EQUIPMENT

(71) Applicant: DYACO INTERNATIONAL INC., Taipei (TW)

(72) Inventors: Hsuan-Fu Huang, Hemei Town (TW); Han-Lin Liu, Hemei Town (TW)

(73) Assignee: DYACO INTERNATIONAL INC., Taipei (TW)

( * ) Notice: Subject to any disclaimer, the term of this patent is extended or adjusted under 35 U.S.C. 154(b) by 302 days.

(21) Appl. No.: 13/842,503

(22) Filed: Mar. 15, 2013

(65) Prior Publication Data

US 2014/0243171 A1 Aug. 28, 2014

(30) Foreign Application Priority Data

Feb. 25, 2013 (TW) ..... 102106596 A

(51) Int. Cl.

| | |
|---|---|
| ***A63B 22/06*** | (2006.01) |
| ***A63B 22/00*** | (2006.01) |
| ***A63B 21/22*** | (2006.01) |
| ***A63B 22/20*** | (2006.01) |

(52) U.S. Cl.

CPC ..... *A63B 21/225* (2013.01); *A63B 22/0012* (2013.01); *A63B 22/0664* (2013.01); *A63B 22/203* (2013.01); *A63B 2022/0676* (2013.01)

(58) Field of Classification Search

CPC ..... A63B 21/225; A63B 21/00192; A63B 21/005; A63B 21/0056; A63B 21/0057; A63B 22/203; A63B 22/0012; A63B 22/0664; A63B 2022/0676; F16F 9/53; F16F 15/005; F16F 15/03

USPC ..... 482/5, 6, 51, 52, 57–65, 114, 115, 482/118–120, 903; 188/156, 157, 161–165; 74/572.2, 574.1; 310/74, 77, 105, 106

See application file for complete search history.

(56) References Cited

U.S. PATENT DOCUMENTS

| | | | | |
|---|---|---|---|---|
| 4,822,032 | A * | 4/1989 | Whitmore et al. | 482/63 |
| 4,958,831 | A * | 9/1990 | Kim | 482/65 |
| 5,643,146 | A * | 7/1997 | Stark et al. | 482/63 |
| 6,712,737 | B1 * | 3/2004 | Nusbaum | 482/8 |
| 7,335,137 | B2 * | 2/2008 | Wu | 482/57 |
| 2003/0153436 | A1 * | 8/2003 | Ho | 482/63 |
| 2005/0075205 | A1 * | 4/2005 | Chen | 474/116 |
| 2005/0200221 | A1 * | 9/2005 | Vasilovich et al. | 310/156.37 |
| 2007/0167294 | A1 * | 7/2007 | Lin | 482/63 |
| 2007/0232465 | A1 * | 10/2007 | Puzey | 482/110 |

FOREIGN PATENT DOCUMENTS

| | | |
|---|---|---|
| TW | I372070 | 9/2012 |

* cited by examiner

*Primary Examiner* — Stephen Crow
*Assistant Examiner* — Gregory Winter
(74) *Attorney, Agent, or Firm* — Huffman Law Group, PC

(57) ABSTRACT

An integrated flywheel set for exercise equipment includes a base plate, a flywheel that is coaxial with the base plate and arranged such that an accommodating space is formed between the flywheel and the base plate, a magnetic damper unit that is deposited on the base plate and received in the accommodating space and provides magnetic attraction to hinder the flywheel from rotation, and a transmission that is received in the accommodating space and configured to drive the flywheel to perform an inertial motion. Thereby, the integrated flywheel set has the magnetic damper unit, a driving wheel set, a driven wheel set, and a multiplying wheel set integrated on the base plate, allowing exercise equipment to have its internal space used more effectively, and making the production and maintenance of the integrated flywheel set easier, thereby providing economical advantage.

8 Claims, 11 Drawing Sheets

INTEGRATED FLYWHEEL SET FOR EXERCISE EQUIPMENT

BACKGROUND OF THE INVENTION

1. Technical Field

The present invention relates to flywheels, and more particularly, to a flywheel set for exercise equipment, wherein the flywheel set integrates a magnetic damper unit and a transmission therein.

2. Description of Related Art

In the recent years, with the rapid progress of industry and business as well as the decline of agriculture, more and more people have moved into metropolises. This increasingly raises urban population density. In the same period, the fast development of technology has caused over-exploiting of our resources and more air pollution in the ambient environment. There is less and less space for people to exercise outdoors. As a result, indoor activities have become the best choice for modern urban residents to keep their physical health by doing exercise anytime and anywhere. Exercise equipment developed for this end includes climbers, elliptical trainers, stationary bikes and more. For allowing exercise in limited indoor space, efforts have been paid to improve these exercise apparatuses in terms of inner space efficiency.

Taiwan Patent No. 1372070, for example, has provided a structure integrating a crank and a load wheel coaxially. The prior patent has a frame with a main shaft pivotally mounted thereon. Cranks are attached to two ends of the main shaft. Also coaxially mounted around the main shaft are a driving wheel set operated by the cranks and a driven wheel set having a load wheel. A multiplying wheel set that is set on the frame next to the load wheel has a small wheel and a large wheel rotating coaxially. The active wheel set uses a linking member to drive the small wheel, while the large wheel uses another linking member to drive the driven wheel set. With the foregoing configuration, the cranks that drive and the load wheel that is driven can be put on the same axle, thereby reducing the floor space taken by the resulting exercise equipment.

However, though the coaxial arrangement of the driving wheel set and the flywheel in prior patent described above is somehow helpful to reduce the volume of exercise equipment, for ensuring the conventional flywheel to function normally, the large and small wheels of the multiplying wheel set have to be set on the frame separated from the flywheel. This limits the possibility of further minimizing the exercise equipment. In addition, for fabricating the flywheel set, the entire exercise equipment has to be put into the production line so as to allow works to install the parts one by one onto the exercise equipment, causing the fabrication quite time-consuming and labor-intensive.

For all the above reasons, it is desirable to have the known design further improved.

SUMMARY OF THE INVENTION

One objective of the present invention is to provide an integrated flywheel set for exercise equipment, wherein the flywheel set has a magnetic damper unit, a driving wheel set, a driven wheel set and a multiplying wheel set integrated on a base plate, allowing exercise equipment to have its internal space used more effectively, and simplifying the production and maintenance of the integrated flywheel set, thereby providing economical advantage.

To achieve the above-mentioned objective, according to the present invention, an integrated flywheel set for exercise equipment comprises a base plate, a transmission, a flywheel and a magnetic damper unit. The base plate has a central hole and an off-center hole. The central hole is formed at the center of the base plate and the off-center hole is separated from the central hole. The transmission comprises a driving wheel set, a driven wheel set and a multiplying wheel set. The driving wheel set has a driving shaft passing through the central hole and a driving wheel mounted around the driving shaft. The driven wheel set has an axle passing through the off-center hole, a small wheel mounted around the axle and rotated by the driving wheel, and a driven wheel mounted around the axle to rotate synchronously with the small wheel. The multiplying wheel set is mounted around the axle and can be rotated by the driven wheel. The flywheel has an axial hole coaxial with the central hole, and a flange extending peripherally from the flywheel toward the base plate. The axial hole receives the multiplying wheel set so that the flywheel is driven to synchronously perform an inertial motion when the multiplying wheel set rotates. An accommodating space is defined by the flange and the he base plate so as to receive the transmission. The magnetic damper unit is deposited on the base plate and received in the accommodating space. The magnetic damper unit has a magnetic attraction that hinders the flywheel from rotation.

Thereby, the present invention integrates the magnetic damper unit, the driving wheel set, the driven wheel set and the multiplying wheel set inside the accommodating space of the flywheel, so as to effectively use inner space of, to reduce manufacturing and transportation costs of, and to simplify production and maintenance of the resulting exercise equipment, thereby providing economical advantage.

For further illustrating the means and functions by which the present invention achieves the certain objectives, the following description, in conjunction with the accompanying drawings and preferred embodiments, is set forth as below to illustrate the implement, structure, features and effects of the subject matter of the present invention in a non-limiting manner.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
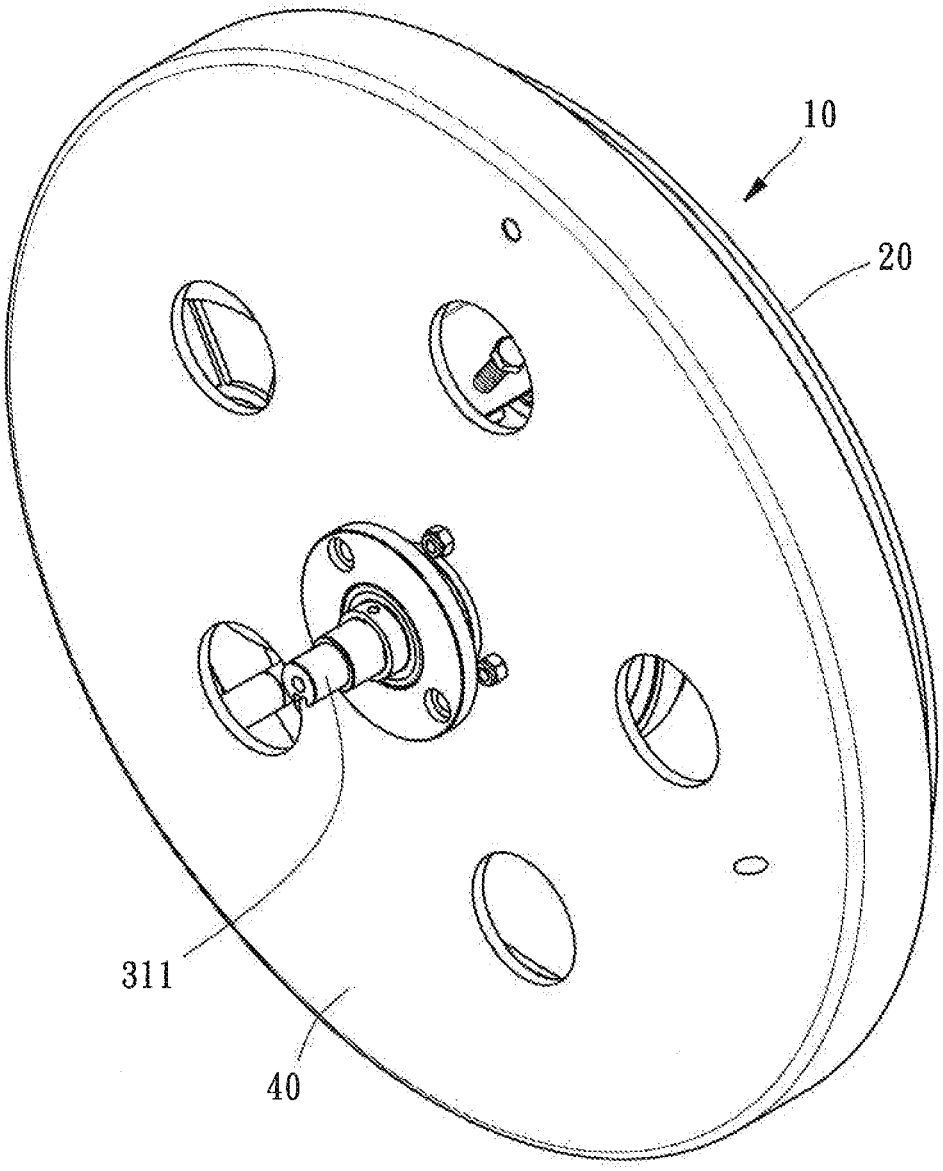
FIG. 1 is a perspective view of one preferred embodiment of the present invention.

Referring to FIG. 1 through FIG. 6, in one preferred embodiment of the present invention, an integrated flywheel set for exercise equipment 10 comprises a base plate 20, a transmission 30, a flywheel 40 and a magnetic damper unit 50.

The base plate 20 has a central hole 21, an off-center hole 23 and a pivot hole 25. The central hole 21 is located at the center of the base plate 20, and the off-center hole 23 is separated from the central hole 21, while the pivot hole 25 is located near the periphery of the base plate 20.

The transmission 30 includes a driving wheel set 31, a driven wheel set 33, and a multiplying wheel set 35. The driving wheel set 31 has a driving shaft 311 passing through the central hole, and a driving wheel 313 mounted around the driving shaft. The driven wheel set 33 has an axle 331 passing through the off-center hole 23, a small wheel 333 mounted around the axle 331 and rotated by the driving wheel 313, and a driven wheel 335 mounted around the axle 331 and rotating synchronously with the small wheel 333. The multiplying wheel set 35 includes a multiplying wheel 351 and a bearing 353 mounted around the multiplying wheel. The bearing 353 is mounted around the driving shaft 311 and the multiplying wheel 351 is driven to rotate by the driven wheel 335.

The flywheel 40 has an axial hole 41 coaxial with the central hole 21, a flange 43 extending from the periphery of the flywheel 40 toward the base plate 20, and a support seat 45. The support seat 45 is coaxial with the axial hole 41 and mounted around the multiplying wheel 351. The support seat 45 can be rotated by the multiplying wheel set 35 to synchronously drive the flywheel 40 to perform an inertial motion. The flange 43 has an inner wall 431. The inner wall 431 is a metallic conductor. An accommodating space 47 is defined by the flange 43 and the base plate 20 so as to house the transmission 30.

The magnetic damper unit 50 is deposited on the base plate 20 and received in the accommodating space 47. The magnetic damper unit 50 includes a magnet set 51 and a control assembly 53. The magnet set 51 has a pivotal end 511 and a free end 513. The pivotal end 511 is rotatably received in the pivot hole 25 near the inner wall 431, and the free end 513 can be driven to move by the control assembly 53, so that the magnet set 51 can pivot against the pivot hole 25 in order to approach or leave from the inner wall 431 of the flywheel 40, thereby using allowing the magnetic damper unit 50 to hinder operation of the flywheel 40 by providing magnetic attraction.

Please refer further to FIG. 3 through FIG. 6 for power transfer involved in the flywheel set 10 of the present invention. First, an external force drives the driving shaft 311 of the driving wheel set 31 and in turn synchronously makes the driving wheel 313 rotate. Between the driving wheel 313 and the small wheel 333 of the driven wheel set 33, a linking member 37 is used as a medium for transferring power. In the present embodiment, the linking member 37 is a belt that can drive the axle 331 to rotate and in turn make the driven wheel 335 rotate synchronously. Due to the bearing 353 existing between the multiplying wheel 351 of the multiplying wheel set 35 and the driving shaft 311, when the driving shaft 311 rotates, the multiplying wheel 351, instead of being restricted by the driving shaft 311, runs against the driving shaft 311. Then the belt transfers the rotational power of the driven wheel 335 to the multiplying wheel 351, and at last the power is transmitted to the flywheel 40 that houses the wheel sets 31, 33 and 35. The support seat 45 of the flywheel 40 is mounted around the multiplying wheel 351, so that the flywheel 40 can generate an inertial rotation with multiplied speed. Thereby, the disclosed transmission 30 can function in the confined accommodating space 47 inside the flywheel as the conventional combination of a transmission and a flywheel does. This is mainly because that the driving wheel 313 having a larger outer diameter drives the small wheel 333 that has a smaller outer diameter, allowing the small wheel 333 to rotate much faster than the driving wheel 313. Another reason is that the driven wheel 335 rotates synchronously with the small wheel 333, and drives the multiplying wheel 351, thereby making the flywheel 40 run faster than the driving wheel 313.

Figure 2:
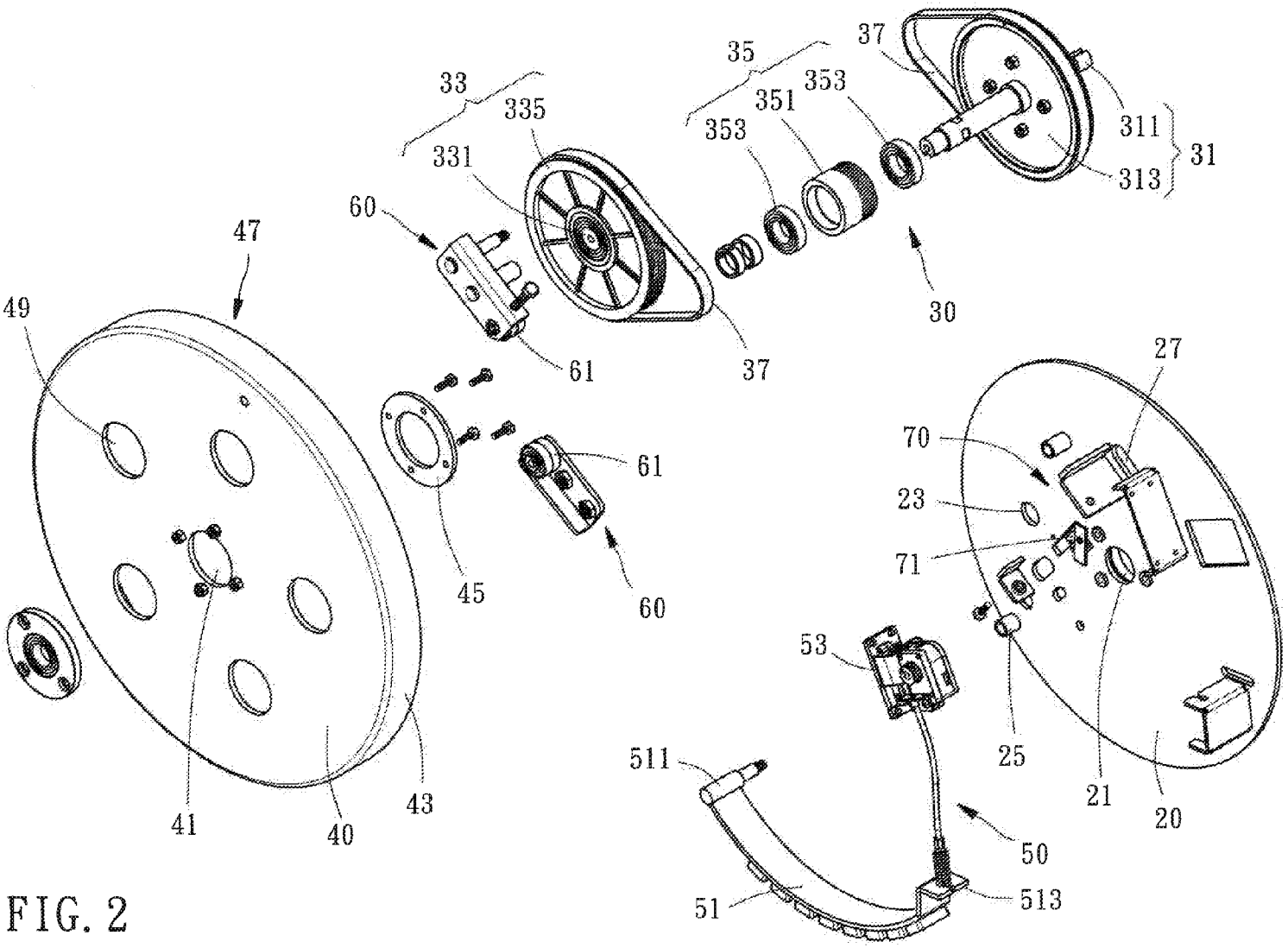
FIG. 2 is an exploded view of the preferred embodiment of the present invention.
Figure 3:
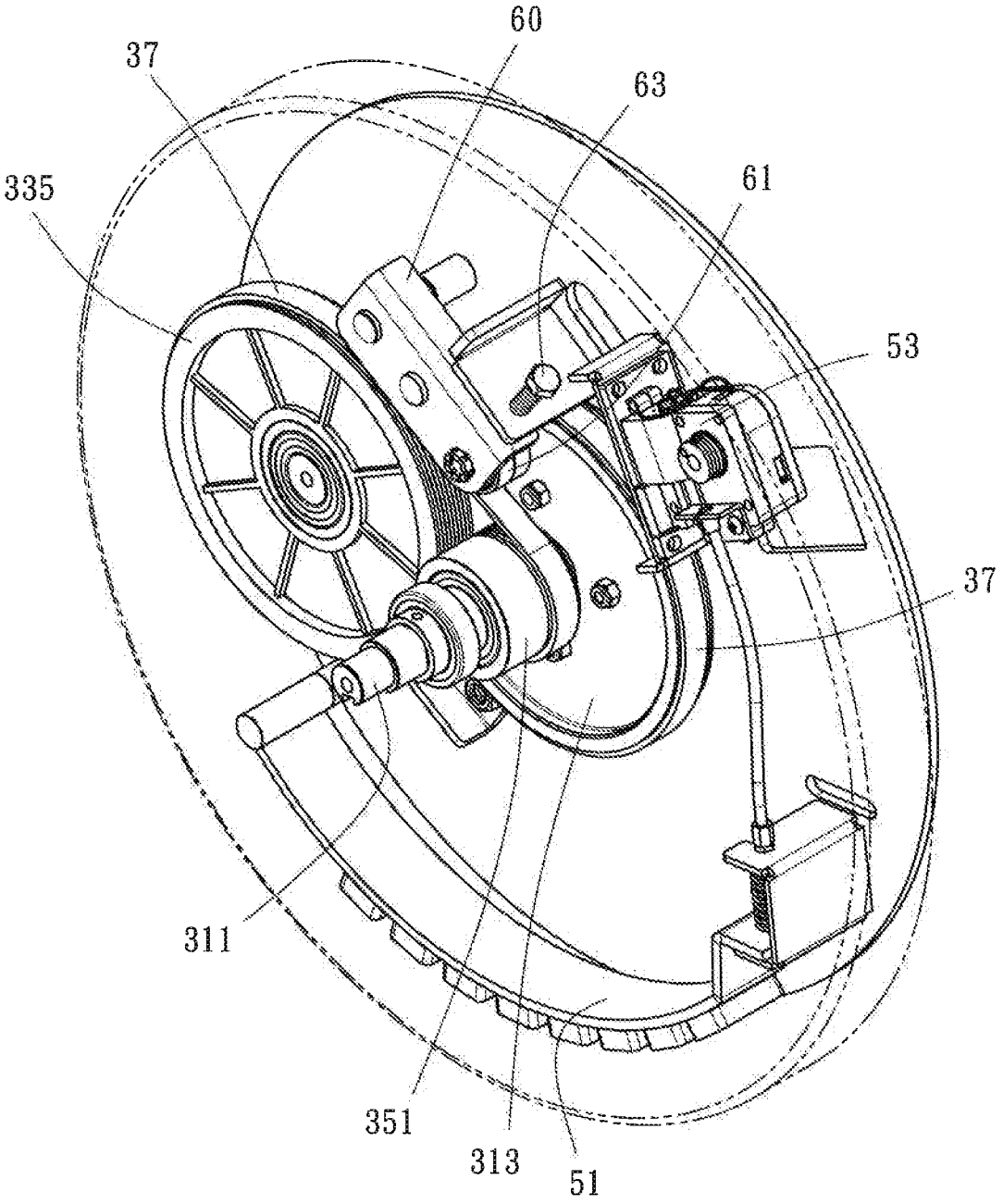
FIG. 3 is a partially cutaway perspective view of the preferred embodiment of the present invention taken from one viewpoint to show the arrangement of main components therein.
Figure 4:
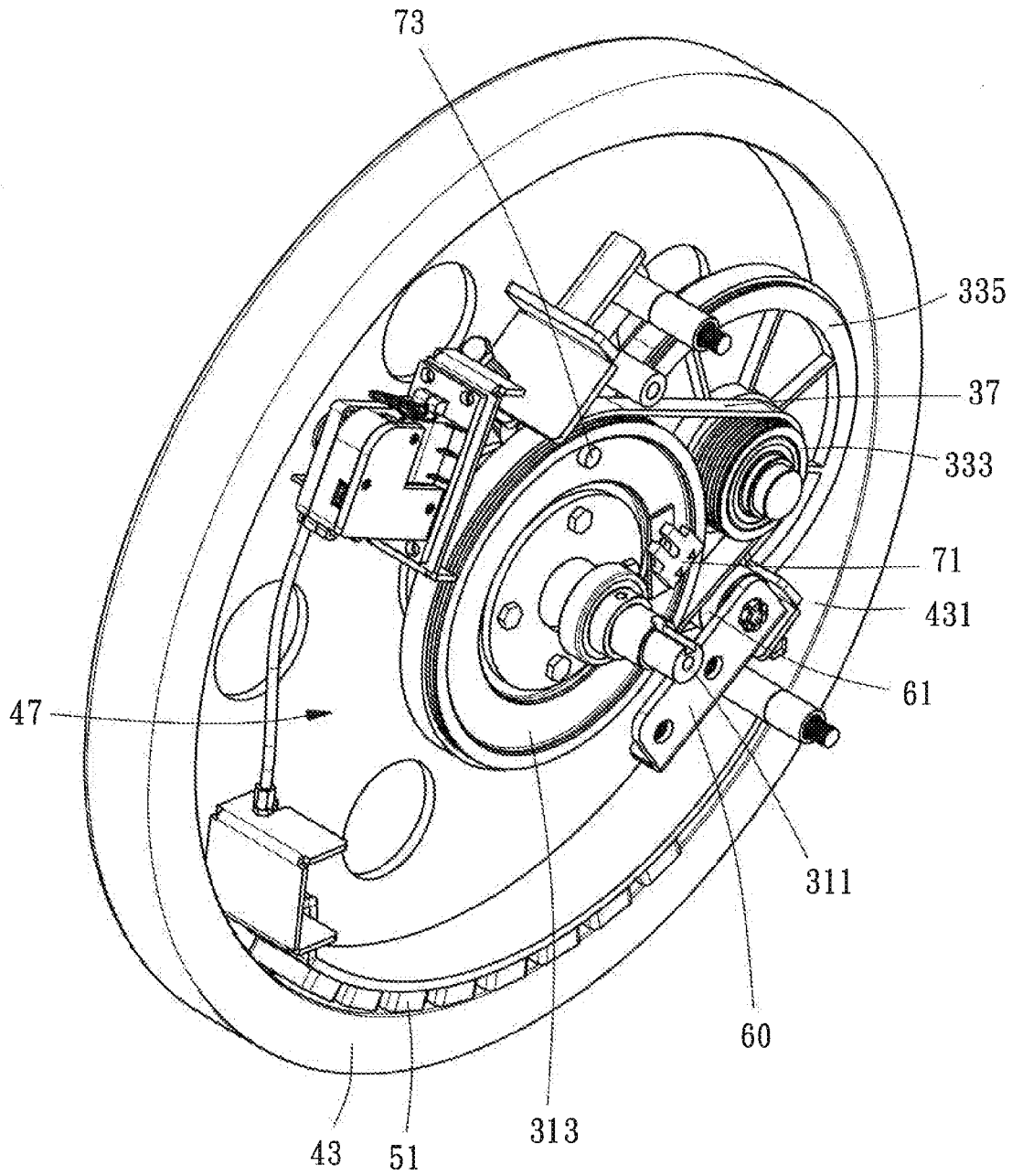
FIG. 4 is a partially cutaway perspective view of the preferred embodiment of the present invention taken from another viewpoint to show the arrangement of main components therein.

Now referring to FIG. 2 and FIG. 4, in the present invention, the base plate 20 is provided with a sensing device 70 near the periphery of the driving wheel 313. The sensing device 70 comprises a passive unit 71, and the driving wheel 313 has an active unit 73 corresponding to the passive unit 71, so that the flywheel set 10 can detect the running speed of the driving wheel 313. In the present preferred embodiment, the passive unit 71 is a sensor capable of identifying magnetic variation and the active unit 73 is a magnet. Thereby, when the driving wheel 313 starts to rotate and the magnet 73 passes by the sensor 71, the sensor 71 is activated and sends a signal to a processing system (not shown) for operation that determines the rotational speed of the driving wheel 313. In addition, through holes 49 are made on the surface of the flywheel 40 and arranged into a circle around the central hole 21. These through holes 49 allow heat generated in the operating flywheel set 10 to disperse therethrough, thereby increasing the service life of the flywheel set 10.

Figure 5:
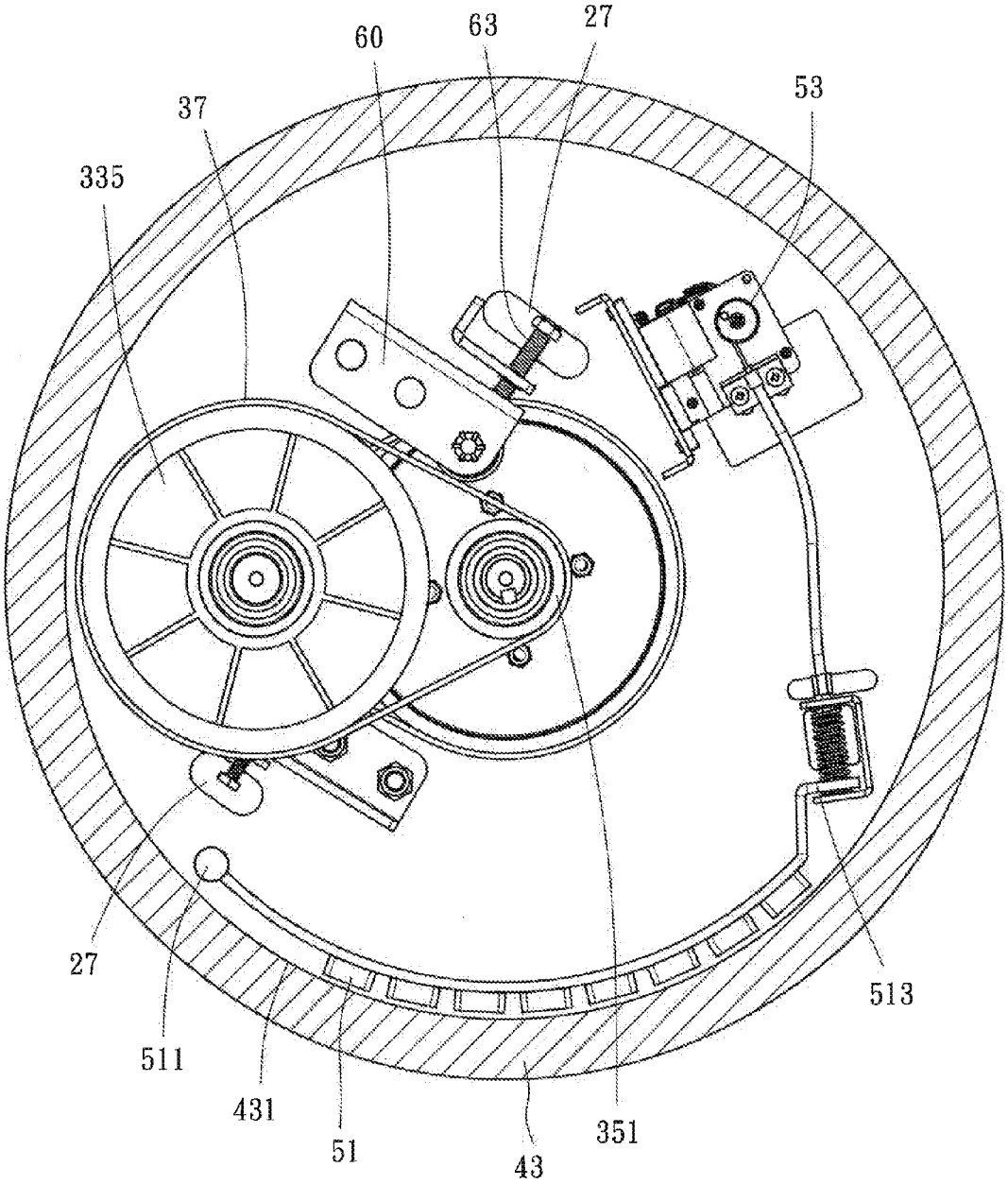
FIG. 5 is a cross-sectional view of the present invention—preferred embodiment the preferred embodiment of the present invention.
Figure 6:
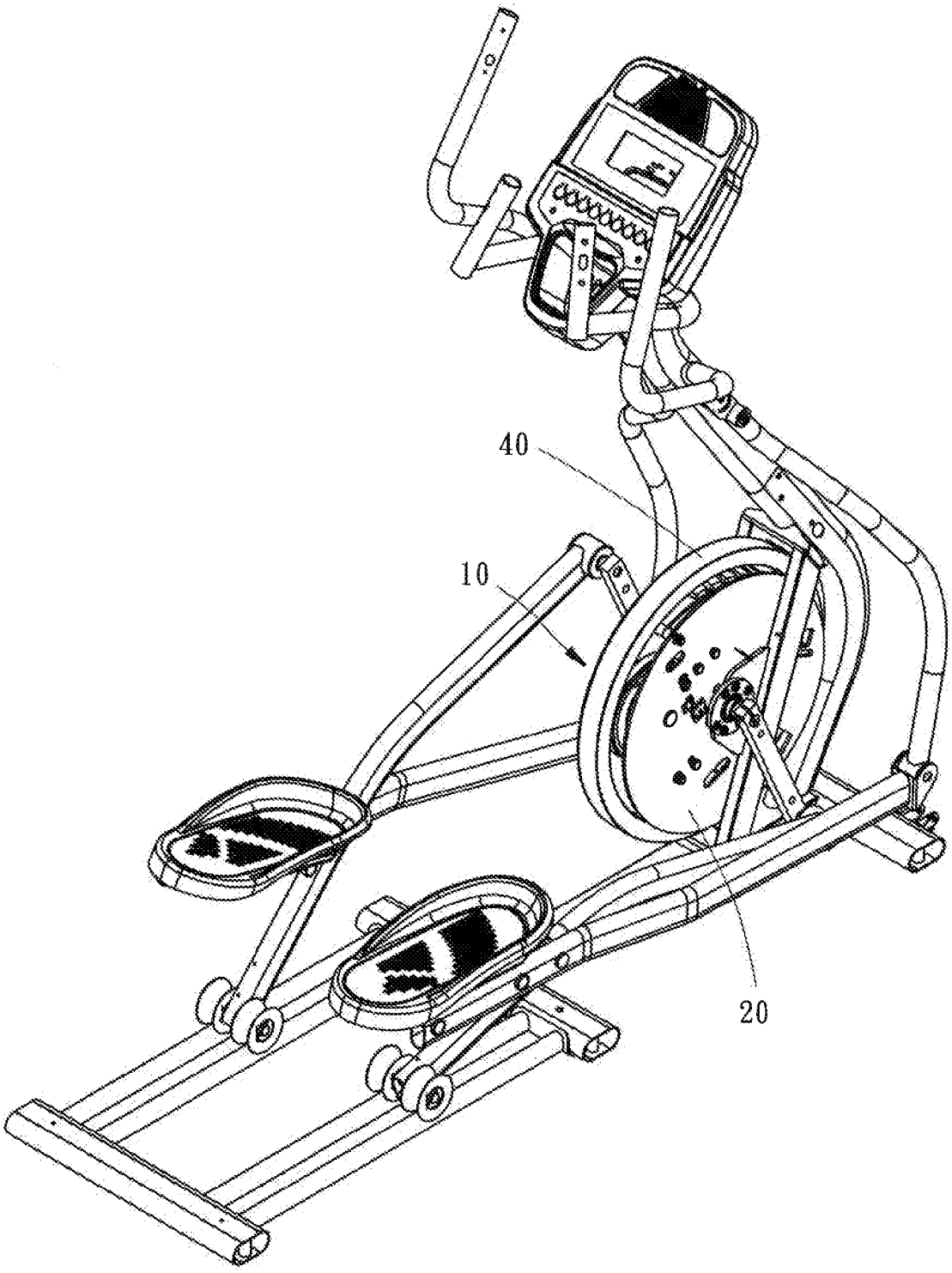
FIG. 6 is an applied view of the preferred embodiment of the present invention, showing the disclosed assembled to exercise equipment.
Figure 7:
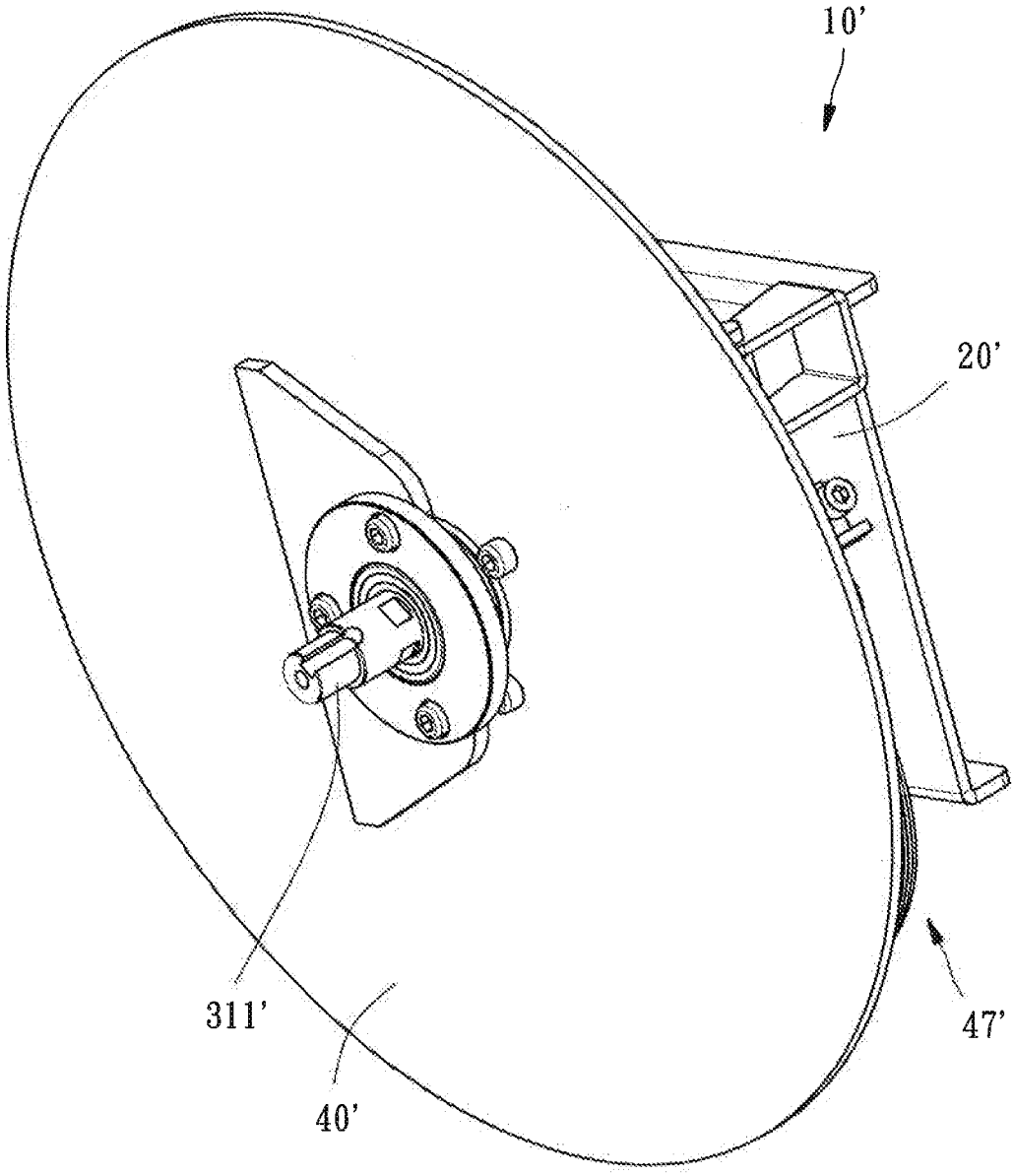
FIG. 7 is a perspective view of another preferred embodiment of the present invention.
Figure 8:
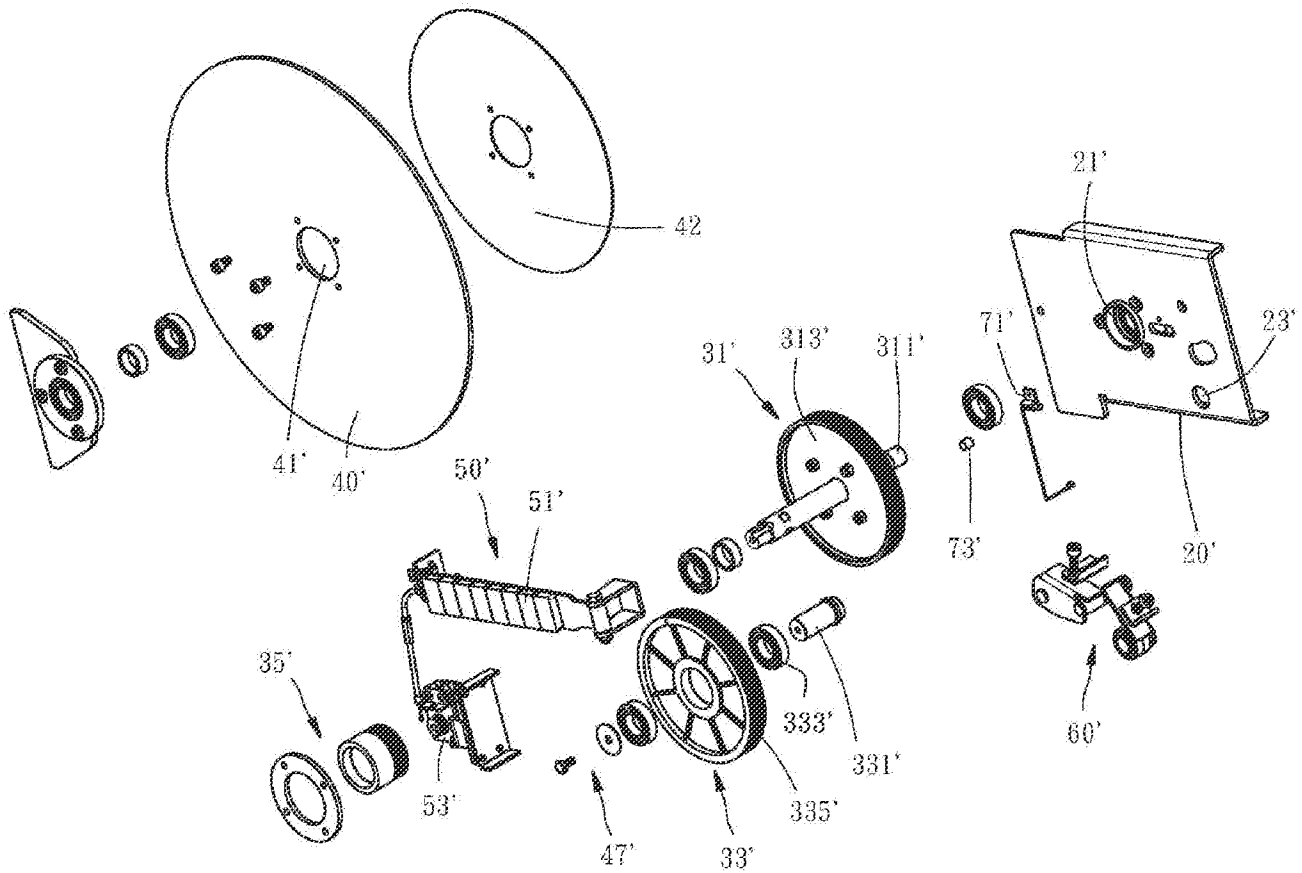
FIG. 8 is an exploded view of the second preferred embodiment of the present invention.
Figure 9:
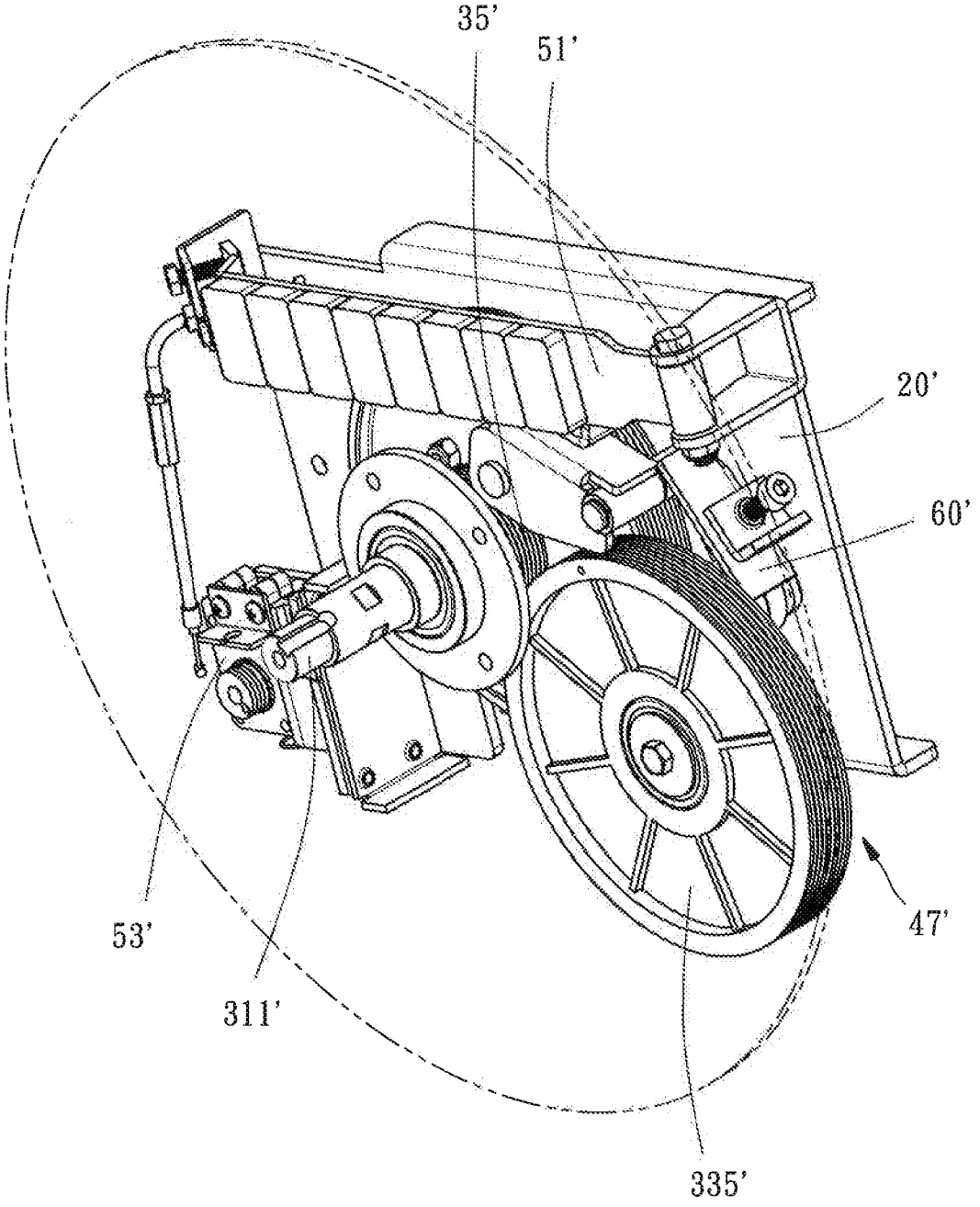
FIG. 9 is a partially cutaway perspective view of the second preferred embodiment of the present invention taken from another viewpoint to show the arrangement of main components therein.
Figure 10:
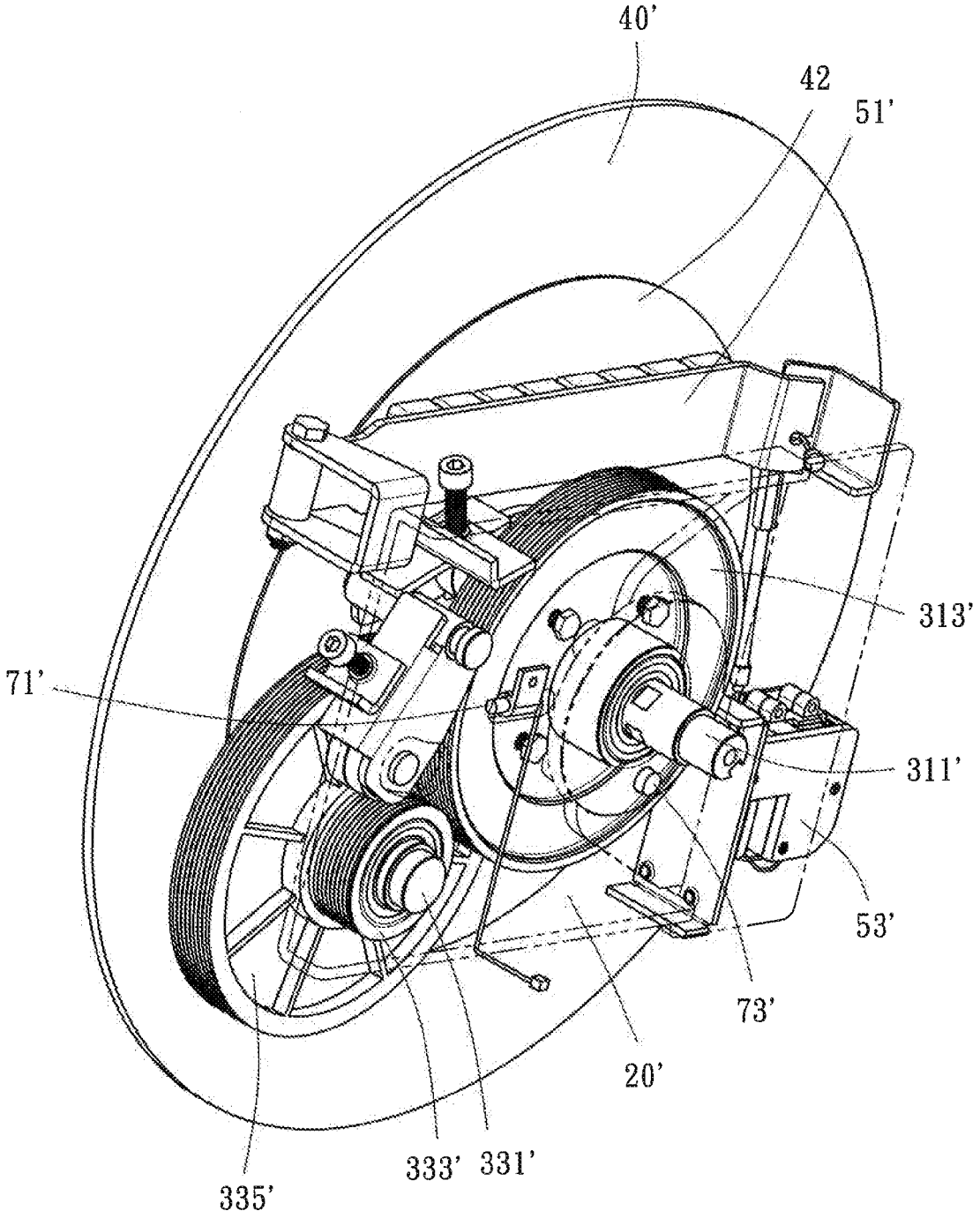
FIG. 10 is a partially cutaway perspective view of the second preferred embodiment of the present invention taken from another viewpoint to show the arrangement of main components therein.
Figure 11:
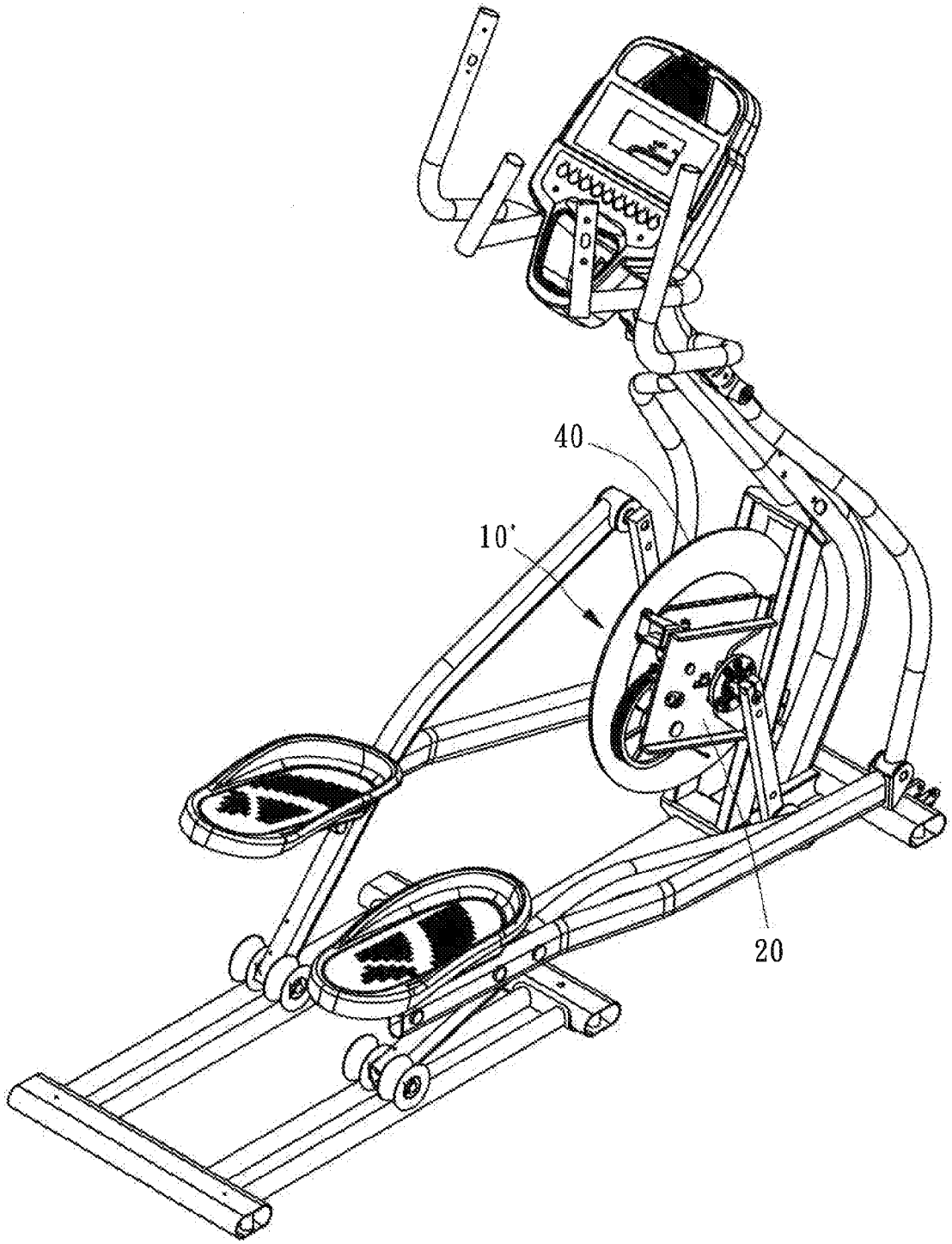
FIG. 11 is an applied view of the second preferred embodiment of the present invention, showing the disclosed assembled to exercise equipment.

Now referring to FIG. 5, a pressure-adjusting wheel set 60 is provided between the driving wheel set and the driven wheel set. The pressure-adjusting wheel set 60 has a pressing wheel 61 for pressing the linking member, and an adjustor 63 that control displacement of the pressing wheel 61, so that the belt 37 can be adjusted in terms of tension. Moreover, for allowing a user or an operator to adjust the belt 37 easily without taking the whole assembly apart, there is a window 27 formed on the base plate 20 aligned with the adjustor 63. Thereby, the user or operator can easily access the adjustor 63 with a simple hand tool through the window 27, accomplishing convenient adjustment of the power-transferring efficiency of the transmission 30.

Reference is now made to FIG. 7 through FIG. 11. As shown, in a second preferred embodiment of the present invention, an integrated flywheel set for exercise equipment 10' comprises a base plate 20', a transmission 30', a flywheel 40' and a magnetic damper unit 50'.

The base plate 20' has a central hole 21' and an off-center hole 23'. The central hole 21' is located at the center of the base plate 20', and the off-center hole 23' is separated from the central hole 21'.

The transmission 30' includes a driving wheel set 31', a driven wheel set 33' and a multiplying wheel set 35'. The driving wheel set 31' has a driving shaft 311' passing through the central hole 21', and a driving wheel 313' mounted around the driving shaft 311'. The driven wheel set 33' has an axle 331' passing through the off-center hole 23', a small wheel 333' mounted around the axle 331' and rotated by the driving wheel 313', and a driven wheel 335' mounted around the axle 331' and rotating synchronously with the small wheel 333'. The multiplying wheel set 35' is mounted around the driving shaft 21' and is driven by the driven wheel 335' to rotate.

The flywheel 40' has an axial hole 41' coaxial with the central hole 21' and defines, together with the base plate 20', an accommodating space 47'. A metallic plate 42 is coaxially arranged next to the flywheel 40' and facing the base plate 20'. The accommodating space 47' can receive the transmission 30' therein. The axial hole 41' is mounted around the multiplying wheel set 35', so that the rotation of the multiplying wheel set 35' can drive the flywheel 40' to synchronously perform an inertial motion.

The magnetic damper unit 50' is deposited on the base plate 20' and located between the base plate 20' and the metallic plate 42. The magnetic damper unit 50' includes a magnet set 51' providing magnetic attraction and a control assembly 53'. The magnet set 51' is parallel to the surface of the metallic plate 42, and the control assembly 53' allows the magnet set 51' to approach or leave from the metallic plate 42, thereby hindering the operation of the flywheel 40'.

Additionally, in the second preferred embodiment, there are also the power transmission among the driving wheel set 31', the driven wheel set 33' and the multiplying wheel set 35', the adjustment of the belt by the pressure-adjusting wheel set 60', a passive unit 71' deposited on the base plate 20' near the periphery of the driving wheel 313', and an active unit 73' provide on the driving wheel 313' to work with the passive unit 71' so as for the flywheel set 10' to detect rotational speed. Since all these features are as their counterparts described in the first preferred embodiment, detailed discussion there to is omitted herein.

To sum up, the present invention integrates the magnetic damper unit 50, 50', and the driving wheel set 31, 31', the driven wheel set 33, 33' as well as the multiplying wheel set 35, 35' of the transmission 30, 30' into the accommodating space 47, 47' of the flywheel 40, 40', thereby achieving effective use of the inner space of, to reduce manufacturing and transportation costs of, and to simplify production and maintenance of the resulting exercise equipment, thereby providing economical advantage.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An integrated flywheel set for exercise equipment, the integrated flywheel set comprising:

a base plate, having a central hole and an off-center hole, the central hole being located at a center of the base plate and the off-center hole being separated from the central hole;

a transmission, including a driving wheel set, a driven wheel set, and a multiplying wheel set, the driving wheel set having a driving shaft passing through the central hole, and a driving wheel mounted around the driving shaft, the driven wheel set having an axle passing through the off-center hole, a small wheel mounted around the axle and rotated by the driving wheel, and a driven wheel mounted around the axle and rotating synchronously with the small wheel, and the multiplying wheel set being mounted around the driving shaft and driven by the driven wheel to rotate;

a flywheel, having an axial hole coaxial with the central hole, the axial hole being mounted around the multiplying wheel set and rotated by the multiplying wheel set so as to synchronously drive the flywheel to perform an inertial motion in a multiplied speed wherein the flywheel has a flange, and the flange of the flywheel has an inner wall, and the inner wall is a metallic conductor, and the base plate has a pivot hole located near the inner wall; and a magnetic damper unit, being deposited on the base plate and located between the base plate and the flywheel, the magnetic damper unit providing a magnetic attraction for hindering the flywheel from rotation wherein the magnetic damper unit includes a magnet set and a control assembly, in which the magnet set has a pivotal end rotatably received in the pivot hole, and a free end configured to be driven by the control assembly, so that the magnet set is allowed to pivot against the pivot hole in order to approach or leave from the metallic conductor.

2. The integrated flywheel set for exercise equipment of claim 1, wherein the flange extends from a periphery thereof toward the base plate, so that the flange and the base plate define an accommodating space that receives the transmission.

3. The integrated flywheel set for exercise equipment of claim 1, wherein the multiplying wheel set includes a multiplying wheel and a bearing mounted around the multiplying wheel, in which the flywheel has a support seat that is arranged coaxial with the axial hole and mounted around the multiplying wheel.

4. The integrated flywheel set for exercise equipment of claim 1, wherein linking members are provided for allowing interaction between the driving wheel and the small wheel, and between the driven wheel and the multiplying wheel, respectively.

5. The integrated flywheel set for exercise equipment of claim 4, wherein a pressure-adjusting wheel set is provided between the driving wheel set and the driven wheel set and has a pressing wheel that presses on the linking members for adjusting the linking members in terms of tension.

6. The integrated flywheel set for exercise equipment of claim 1, wherein a passive unit is deposited on the base plate near an outer periphery of the driving wheel, and an active unit is deposited on the driving wheel corresponding to the passive unit, for working together for the flywheel set to detect a rotational speed thereof.

7. An integrated flywheel set for exercise equipment, the integrated flywheel set comprising:

a base plate, having a central hole and an off-center hole, the central hole being located at a center of the base plate and the off-center hole being separated from the central hole;

a transmission, including a driving wheel set, a driven wheel set, and a multiplying wheel set, the driving wheel set having a driving shaft passing through the central hole, and a driving wheel mounted around the driving shaft, the driven wheel set having an axle passing through the off-center hole, a small wheel mounted around the axle and rotated by the driving wheel, and a driven wheel mounted around the axle and rotating synchronously with the small wheel, and the multiplying wheel set being mounted around the driving shaft and driven by the driven wheel to rotate;

a flywheel, having an axial hole coaxial with the central hole and defines, together with the base plate, an accommodating space, and being coaxially provided with a metallic plate that faces the base plate, the accommodating space can receive the transmission therein, the axial hole being mounted around the multiplying wheel set and rotated by the multiplying wheel set so as to synchronously drive the flywheel to perform an inertial motion; and a magnetic damper unit, being deposited on the base plate and located between the base plate and the metallic plate, the magnetic damper unit including a magnet set that provides magnetic attraction and a control assembly, the magnet set being parallel to a surface of the metallic plate, and the control assembly controlling the magnet set to approach or leave from the metallic plate, so as to hinder the flywheel from rotation.

8. The integrated flywheel set for exercise equipment of claim 7, wherein a passive unit is deposited on the base plate near an outer periphery of the driving wheel, and an active unit is deposited on the driving wheel corresponding to the passive unit, for working together for the flywheel set to detect a rotational speed thereof.

* * * * *